US005938034A

United States Patent [19]

Josephsen et al.

[11] Patent Number: 5,938,034

[45] Date of Patent: Aug. 17, 1999

[54] PACKAGE AND A METHOD OF PACKAGING AT LEAST TWO MUTUALLY REACTIVE PHOTOGRAPHIC CHEMICALS

[75] Inventors: Birger Josephsen, Solrød Strand; Kaj Nielsen, Tranbjerg, both of Denmark

[73] Assignee: Deltagraph A/S, Ringsted, Germany

[21] Appl. No.: 08/840,176

[22] Filed: Apr. 14, 1997

Related U.S. Application Data

[63] Continuation-in-part of application No. PCT/DK95/00404, Oct. 11, 1995, abandoned.

[30] Foreign Application Priority Data

Oct. 19, 1994 [DK] Denmark ..... 1211/94

[51] Int. Cl.[6] ..... B65D 83/06; B65D 81/32

[52] U.S. Cl. ..... 206/568; 53/434; 53/469; 53/474; 206/524.8

[58] Field of Search ..... 53/434, 469, 474; 206/219, 221, 222, 568, 524.8

[56] References Cited

U.S. PATENT DOCUMENTS

| | | | |
|---|---|---|---|
| 2,015,972 | 10/1935 | Sodergren | 206/568 |
| 3,756,389 | 9/1973 | Firth | 206/219 |
| 3,809,224 | 5/1974 | Greenwood | 206/219 |
| 3,891,138 | 6/1975 | Glas | 206/222 |
| 3,940,905 | 3/1976 | Perry, 3rd | 53/474 |
| 4,226,330 | 10/1980 | Butler | 206/219 |
| 4,428,485 | 1/1984 | Egli | 206/524.8 |
| 5,072,830 | 12/1991 | Nielsen | 206/524.8 |
| 5,204,230 | 4/1993 | Hayashi | 206/524.8 |
| 5,407,278 | 4/1995 | Beer . | |

FOREIGN PATENT DOCUMENTS

| | | |
|---|---|---|
| 0333075 | 9/1989 | European Pat. Off. . |
| 0434105 | 6/1991 | European Pat. Off. . |
| 0594449 | 4/1994 | European Pat. Off. . |
| 2938413 | 4/1980 | Germany . |
| 9427886 | 12/1994 | WIPO . |

*Primary Examiner*—Jim Foster
*Attorney, Agent, or Firm*—Thomas R. Vigil

[57] ABSTRACT

A package (1) for measured amounts of different photographic chemicals, which are to be stored apart and which are to be discharged simultaneously with a view to stirring into liquid, comprises an outer membrane (4) and at least one partition wall (5) that divides the chamber delimited by the outer membrane into two compartments (3,3). According to the invention, the package comprises a storage portion (12) and a neck portion (13), said partition wall extending across both portions, and those portions of the compartments which are disposed within the storage portion essentially containing the full, measured amounts of chemicals. The neck portion is so designed that a single cut along the cutting line (11) opens both chambers. The neck portion has such length that the chemicals may be retained in the package while the openings are immersed below a liquid surface to allow subsequent discharge of the amounts into the liquid without contacting the ambient air and without contacting each other before they have been discharged into the liquid.

7 Claims, 2 Drawing Sheets

PACKAGE AND A METHOD OF PACKAGING AT LEAST TWO MUTUALLY REACTIVE PHOTOGRAPHIC CHEMICALS

CROSS-REFERENCE TO RELATED APPLICATION

This is a continuation-in-part international application PCT/DK95/00404 with an international filing date of Oct. 11, 1995, now abandoned.

This application is based on application No. 1211/94 filed in Denmark on Oct. 19, 1994, the content of which is incorporated hereinto by reference.

FIELD OF THE INVENTION

The present invention relates to a package comprising at least two compartments which contain different photographic chemicals that are to be stored apart in the package. The invention further relates to a method of packaging at least two mutually reactive photographic chemicals.

THE PRIOR ART

In the development of of photographic films, developer and fixing baths are used that consist of aqueous solutions of different chemicals which may react with the components of the films. The active ingredients in the baths are consumed in the intended reactions and therefore it is sometimes necessary to add fresh supplies of chemicals.

In the baths, a number of different chemicals are used which are to be present in very specifically measured ratios relative to each other to ensure the optimum result. It is therefore convenient for the user have the active materials delivered in measured dosages in order to enable him to dispose of the used bath and quickly produce another simply by measuring a suitable amount of water and adding the ready-measured portions of active chemicals.

Portions of concentrated chemicals may be produced either as solids or liquids, and both methods are represented on the market. Concentration of the chemicals into solid state presents the advantage of providing the lowest possible transportation volume and the lowest possible weight whereas liquid chemicals present the advantage of being more readily dissolved for complete admixture with or dissolution in liquid.

It is particular to photographic chemicals that one single bath uses a mixture of a number of different chemicals which cannot be stored and transported in admixed state due to a mutually degradable reaction even when the chemicals are in their solid states. It is therefore necessary to maintain at least some of the chemicals separated until they are to be stirred into a liquid which makes the handling complicated for the producer as well the consumer.

U.S. Pat. No. 4,770,979 describes the different components in photographic developer compositions and suggests a system with separate containers. Such solutions have a certain market appeal although they present handling inconveniences in the form of the complex handling of various packages which must be matched relative to each other, and the risk of errors due to unintended combinations thereof.

U.S. Pat. No. 4,657,134 teaches a compartmented package intended for fluids which are to be kept separated until immediately prior to their use, e.g. photographic chemicals, wherein the package is in essence provided with a smaller container portion arranged inside a slightly bigger container portion and wherein the two compartments are sealed with a common welding across a filling end. The two containers are moulded and are to match exactly and apparently be filled completely with the incoming fluids without room for adjustment of the amounts during the filling process.

U.S. Pat. No. 3,390,507 describes a dual compartment container obtained by folding a film web in order to provide compartments which may simultaneously be filled, sealed, opened and emptied; the latter by tearing along a single perforating line to allow the contents to be admixed immediately following opening.

EP patent No. 0 196 551 teaches a package with a single compartment for particulate photographic chemicals. The different particulate chemicals are successively filled into the package in separate layers and the package is evacuated before it is hermetically sealed thereby completely preventing the particles from moving relative to each other. The chemicals which are to be prevented from contacting each other due to the ensuing risk of mutual reaction are kept apart by separate layers of inert particles.

Thus, the solution presupposes that it is possible to arrange the photographic chemicals which constitute the composition in an orderly sequence with stable interfaces between all layers of different particles, a presupposition which necessarily limits the range of compositions which can be marketed in this manner. Moreover, the components thereof must all be completely dry in order to avoid any danger of liquid transporting the chemicals from one layer to the others.

Stirring of photographic chemicals into water may be a critical process since the chemicals may be caused to influence each other adversely before they are completely dissolved. The solubility of one chemical may be reduced in the presence of another chemical. During the stirring step, some chemicals may locally achieve such high concentrations that they lead to decomposition of other components and formation of undesirable agglomerates comprising different chemicals. Such difficulties must be encountered by controlled introduction of the components and vigorous stirring in the mixing vessel. Finally, there is a risk of adversely influencing the working environment by swirling fine powder in the air with the ensuing risk of the operator inhaling hazardous chemicals.

SUMMARY OF THE INVENTION

The invention provides a packaging comprising at least two compartments containing measured amounts of different photographic chemicals that are stored apart in the package and which are to be discharged substantially simultaneously with the purpose of being stirred into liquid; said package comprising a flexible, substantially airproof outer membrane which defines an enclosed chamber and at least one flexible partition wall that divides the chamber thus delimited into two compartments, said package being characterized by comprising a storage portion and a neck portion, the partition wall extending across both portions, wherein the portions of the compartments disposed within the storage portions substantially contain the full measured amounts of chemicals thereby allowing that those portions of the compartments which are arranged within the neck portion are substantially void of chemicals, and wherein the neck portion is so designed that both compartments may be opened to the surroundings by a single cut, and wherein the neck portion is long enough for the openings of the compartments to be located at such distance from the storage portion that the amounts of chemicals may be retained in the package while the openings are conveyed below a liquid surface thereby permitting subsequent, substantially simultaneous discharge of the amounts into the liquid while substantially eliminating any contact between the chemicals and the ambient air and with eachother prior to discharge into the liquid.

A package is hereby provided that allows transportation and storage of photographic chemicals and which makes minimum requirements to space, said package being very conveniently and reliably opened by one single cutting operation, wherein the contents may be poured into liquid without any danger of dust being swirled in the air, wherein mutually reactive components are kept apart and away from the ambient air until they have been discharged into the liquid, which package may be emptied and rolled up flat without any danger at any time that dust is emitted from the contents. The chemicals which constitute the compositions may be powderous or liquid, or some may be powderous and others may be liquid, since it is possible to keep powderous and fluid chemicals in each their separate compartment within the package.

According to a preferred embodiment, all chemicals are powderous and the package has been evacuated of air whereby it is ensured that its contents are substantially immovable. This provides a package of minimum volume.

According to a preferred embodiment, the storage area of the package is substantially box-like while the neck portion is flexible. This provides a package which may be piled with minimum waste space between the individual packages.

According to a preferred embodiment, the package comprises two partition walls and three internal compartments. Thus, the package may contain a total of three mixtures which are kept apart as will be required in case they are all mutually reactive.

The invention further provides a method of packaging at least two mutually reactive photographic chemicals and comprising filling of photochemicals into respective, upwardly open compartments formed in a bag which consists of a flexible, substantially airproof outer membrane that forms an upwardly open chamber, and at least one flexible partition wall which divides the chamber into the respective upwardly open compartments, wherein the filling of the compartments is carried out in a balanced manner and with measured amounts, and wherein the compartments and the bag are proportioned in such a manner relative to the measured amounts that, following filling, an unfilled neck portion of the bag remains, whereupon the opening of the bag is hermetically closed at the upper end of the neck portion to provide substantially hermetical, individual sealing of each of the two compartments.

Hereby a method is provided wherein several mutually reactive, photographic chemicals may be packaged in a convenient manner in order to allow easy handling of the package both at the producer's and the consumer's end and wherein the photographic chemicals may comprise powderous substances, liquid substances, or partly powderous and partly liquid substances. The neck portion of the bag allows the user to open the package by cutting near the top and subsequently to immerse the opening below the liquid surface in the mixing vessel before the package is emptied so as to permit simultaneous discharge of the different ingredients which have been kept apart until they reach the liquid.

Such balanced filling of the compartments ensures that the partition wall will remain substantially upright in the bag thereby allowing unimpeded discharge of the bag's contents. The package may be emptied completely and rolled up flat without any dust being emitted to the ambient air at any time.

According to a preferred embodiment, the bag is evacuated prior to closure to establish a subatmospheric pressure in the bag. Hereby the volume of the package is minimized, and when its contents are powderous, the package will assume a solid and stable form.

According to a preferred embodiment, the package is supported by two pairs of jaws during filling, each pair pinching one of the lateral weldings to ensure convenient and stable securing of the bag. The partition wall is advantageously supported during filling to avoid the danger of irregular folding caused by the filling material during the filling procedure. Hereby, such folding of the partition wall, which would otherwise trap material during the emptying procedure, is avoided.

According to a preferred embodiment, the partition wall is preferably extended during filling by means of two supporting means which secure the partition wall in a waved path seen in a sectional view perpendicular to the lateral weldings in order to keep the partition wall extended between the two jaw pairs. This imparts to the package an even and regular shape since the slack length of the partition wall likely to result when a bag made of plane films is to be converted to voluminous bag shape, is caught and caused to follow a controlled, advantageous path where the partition wall will adjust itself so as not to retain material during emptying.

According to a preferred embodiment the bag is vibrated following filling so as to even out the surface of the material contained therein and to shape the filling in such a manner that, following evacuation, the package is sub- stantially box-shaped. Hereby a package is obtained which may be piled with a minimum of waste space between the individual packages.

The invention will be described in further detail in the following description which is given with reference to the drawings.

DETAILED DESCRIPTION OF THE PREFERRED EMBODIMENTS

Figure 1:
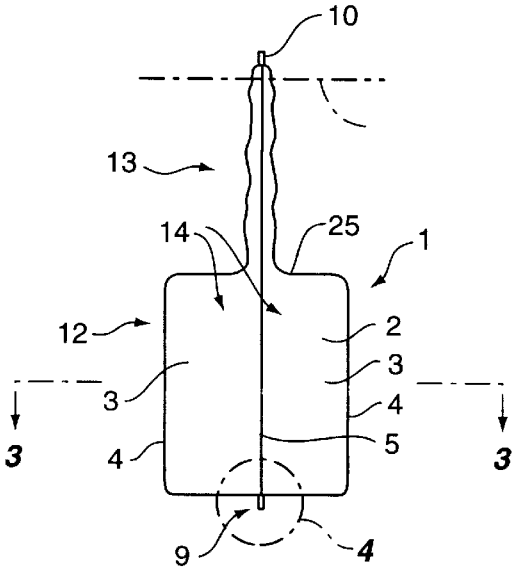
FIG. 1 is a view of a fully evacuated package according to a first embodiment of the invention and containing powderous material, sectioned by a plane which is substantially vertical and substantially perpendicular to the partition wall.

All figures are schematical and not to scale and illustrate only details essential to the understanding of the invention while other details have been omitted. In all figures the same reference numerals are used for identical or corresponding details. The terms "vertical" and "horisontal" as well as "top" and "bottom", respectively, used in connection with the package are, where not otherwise defined, to be understood as relating to an orientation of the package where the opening is upwardly oriented as will be the case during filling.

Reference is first made to FIG. 1 which is a vertical, sectional view of a finished package, filled and sealed. In essence, the package comprises a bag 1 made from an outer membrane 4 which defines a chamber 2. Within this chamber a partition wall 5 is provided which divides the chamber 2 into two compartments 3,3. As will to some extent appear from FIG. 2, the bag is made of three film sheets having substantially identical rectangular contours, said film sheets being joined by two lateral weldings 8, a bottom welding 9 and a top welding.

Conveniently the outer membrane 4 comprises a laminar material which comprises at least two layers (cf. FIG. 4), of which the one layer 7 which is arranged inwardly must be thermofusible while the layer 6 which is arranged outwardly is advantageously heat resistant, vacuumproof and optionally light-impervious. According to a preferred embodiment the outermost layer comprises polyamide and the innermost layer polyethylene. The intermediate partition wall may be made of a single layer of thermofusible material, preferably polyethylene. The outer membrane may optionally be coated with or laminated in combination with an aluminium foil which renders the package impervious to light.

The invention may be exercised with other materials than those given above, and the walls may be joined in other ways, in particular by glueing.

Figure 4:
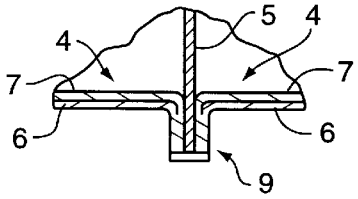
FIG. 4 is an enlarged view of a detail from the bottom welding of the package illustrated in FIG. 1.

FIG. 4 is a sectional view through the bottom welding 9 to indicate how the two outer membranes 4 and the partition wall 5 are joined by a single hot-melting operation. The embodiment shown provides a bag which is very strong and hermetically airproof and which can be produced at comparatively low costs.

FIG. 1 illustrates how the material 14 contained in the bag substantially fills the lower half of the bag, the portion which is designated the storage portion 12, whereas the remaining portion of the bag which constitutes the neck portion 13 has collapsed following the evacuation and welding of the bag. The transition area between the storage portion and the neck portion, designated 25, adjusts to the level to which the bag has been filled with the filling material. Since it is essential to the invention that the neck portion of the bag is of suitable length, it is important that the volume of the bag and the volume of the filling material have been matched relative to eachother.

Figure 2:
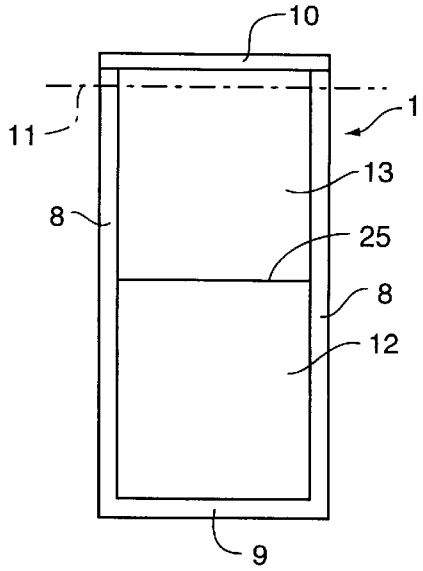
FIG. 2 is a plan view seen from the side of the package illustrated in FIG. 1, seen transversely to the partition wall.

In FIGS. 1 and 2, a dotted line at the top of the neck portion immediately below the top welding 10 serves to designate a cutting line 11 which indicates where the user is to cut the bag open in order to discharge its contents.

Figure 5:
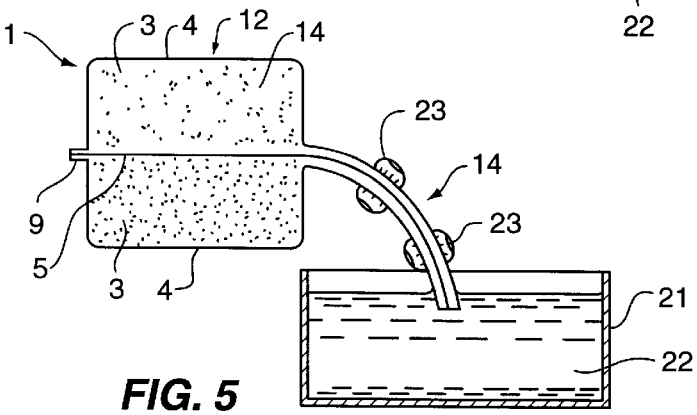
FIG. 5 is a vertical sectional view through a package and a mixing vessel with liquid immediately prior to the discharge of the contents of the package.

This cutting effects simultaneous opening of both compart- ments in the bag and the subatmospheric pressure inside the bag is equalized, however, experience has shown that the powder remains quite stable. In order to stir the contents into liquid, the user proceeds, following cutting, to the step illustrated in FIG. 5. In that stage the user holds the bag above the mixing vessel 21 containing the liquid 22 into which the contents of the bag are to be stirred. Initially the user holds the bag in such a manner that its contents remains in the storage portion 12, if necessary he pinches the neck portion of the bag tightly with two fingers 23 at the transition portion 25 while using his free fingers to direct the outermost end of the neck portion with the newly cut opening downwards below the surface of the mixing liquid 22 as shown in FIG. 5. This procedure serves to avoid that air enters the bag and that powder from the bag is emitted to the air. According to the invention, the package is to be designed in such a manner that the neck portion is sufficiently long for the user to be able to carry out said procedure, i.e. to convey the bag's opening down below the liquid surface while simultaneously retaining the bag's contents.

Figure 6:
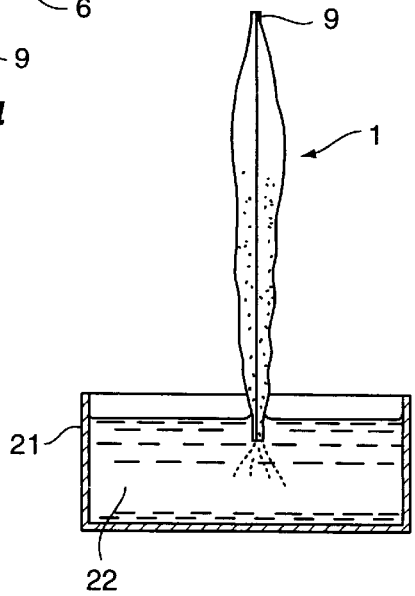
FIG. 6 illustrates a later stage during the discharge of the contents of the package shown in FIG. 5.

Once the bag's opening has been conveyed below the surface of the mixing liquid, the user lifts the bag bottom upwards to the position shown in FIG. 6 and releases the neck portion whereby the contents of the bag is discharged into the mixing liquid. Since the opening of the bag has been conveyed down below the liquid level, there is no risk that air is drawn into the bag during emptying, and therefore the contents will be discharged while the sides of the bag collapse comparatively tightly. Finally the user rolls up the bag from the end to terminate the emptying process and to minimize the volume of the empty bag while simultaneously eliminating the risk of air being drawn into and possibly later blown out of the bag.

Figure 7:
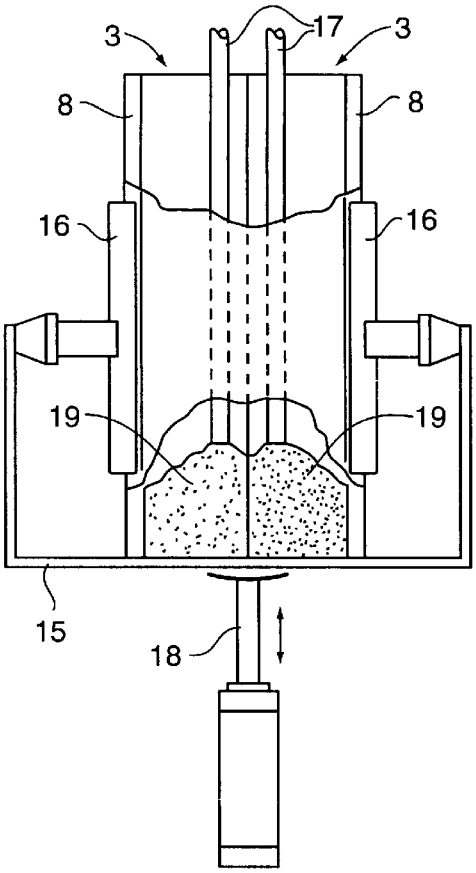
FIG. 7 shows a package during filling wherein portions have been cut away.
Figure 9:
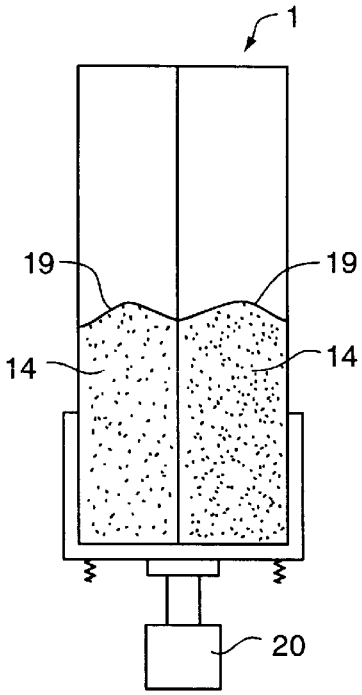
FIG. 9 is a vertical sectional view of a filled package prior to sealing arranged on a vibrating table and wherein the sectional plane transverses the two lateral weldings.
Figure 8:
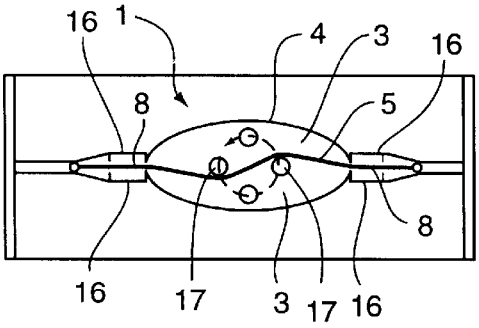
FIG. 8 is a top plan view corresponding to the illu- stration given in FIG. 7.

Reference is now made to FIGS. 7, 8 and 9 for a description of the filling operation of the bag. The bag, which has previously been formed by welding of the three film sheets to each other along bottom and sides, is arranged on a support 15 and secured by means of two pairs of fastening jaws 16 that pinch each a respective lateral welding. The bag is opened at the top in a manner not shown in detail and two filling tubes 17 are conducted downwards from above on each their side of the partition wall 5 and are inserted so far into the bag, that the lower edges of the filling tubes are slightly above the bag's bottom. The positions of the filling tubes in this step is indicated with a dotted line in FIG. 8.

According to the preferred embodiment, the filling tubes 17 are subsequently displaced in the horizontal plane, e.g. by turning the filling tube pair 45–90° about a vertical axis centrally between them along the dotted circle in FIG. 8 to the position shown with a fully drawn line in FIG. 8 whereby the partition wall 5 is extended in zig-zag-like or S-shaped path from one lateral welding to the other. Hereby the slack will be absorbed which would otherwise automatically form when a bag made of plane film sheets is opened to voluminous shape, and the partition wall is kept extended with a certain friction against the outsides of the filling tubes. Although in the preferred embodiment the partition wall is supported by the filling tubes, other embodiments where the supporting function is carried out by separate supporting means are possible.

The material to be contained in the respective compartments is supplied in ready-measured portions to the respective filling tubes and pours downwards into the two compartments 3 of the bag. In pace with the climb of the level of the material in the bag, the support 15 and the fastener jaws 16 are gradually displaced downwards by movement in a vertically displaceable supporting mechanism 18, while the partition wall slides along the filling tubes to allow the powder to gradually enter the bag from the bottom and upwards. The filling levels of the two compartments of the bag are automatically restrained by the lower edges of the filling tubes, and therefore the filling of the two compartments will be effected in a reasonably balanced manner, thus avoiding lateral displacement of the partition wall, provided that the relative pulling up of the filling tubes is carried out at essentially the same pace as the outflow of the powder. The relative, vertical movement between filling tubes and bag allows gradual filling of the bag from the bottom with minimal swirling of dust, and the filling may be carried out substantially without any dust precipitating on the insides of the neck portion. It is advantageous in the subsequent welding procedure to be effected at the top of the bag that no powder covers the surfaces to be welded.

Figure 3:
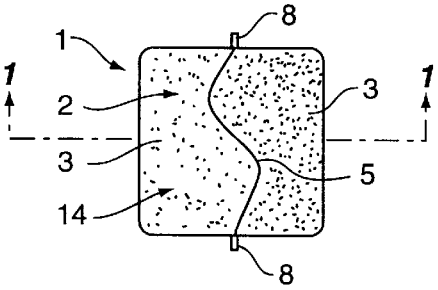
FIG. 3 is a horizontal sectional view of the package illustrated in FIG. 1, the sectional plane being indicated in FIG. 1 along the line III—III.

When the ready, measured portions of chemicals have been discharged into the bag, the latter is taken to a vibration table 20 shown in FIG. 9 where the bag with the powder is vibrated to even the filling surface level 19 until the surface becomes substantially horizontal. During this process the partition wall 5 may move to either side to cause evening of the respective levels of the two compartments. The bag is subsequently taken to a vacuum-sealing station (not shown) where the internal volume is evacuated, thereby causing the outer membrane 4 and the partition wall 5 to collapse tightly in the neck portion whereupon the bag is sealed hermetically with a top welding to obtain the shape outlined in FIGS. 1, 2 and 3.

According to a preferred embodiment, the storage portion 12 of the bag is formed during the vibration and evacuation procedures in such a manner that the finished package becomes largely box-shaped as regards the storage region. Methods of forming evacuated packages with well-defined outer shapes are considered known in the art and consequently they will not be described in further detail herein. Following evacuation and sealing the neck portion 13 is easily pliable and may readily be folded so as to impart to the package unit a convenient shape for further handling.

Figure 10:
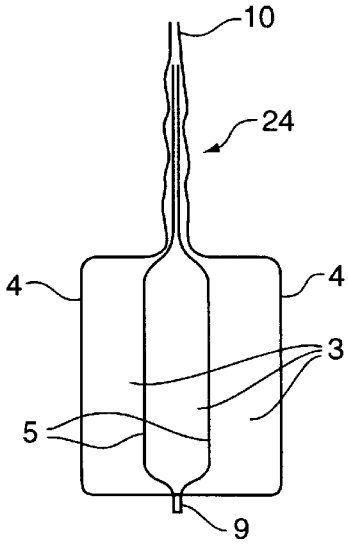
FIG. 10 is a vertical, sectional view of a package according to a second embodiment of the invention, the view corresponding to the one illustrated in FIG. 1.

Reference is now made to FIG. 10 which is a sectional view corresponding to the view shown in FIG. 1 but depicting a package according to a second embodiment, viz. a bag 24 with two partition walls 5, i.e. the bag has three internal compartments 3,3,3. Like the first embodiment, the outer membranes 4 of this embodiment are composed of laminated films which are thermofusible on the inside while each of the two partition walls 5,5 of this embodiment is made in exactly the same manner as the partition wall in the first embodiment.

The invention will now be described in further detail with reference to the following example.

EXAMPLE

A dual-compartment bag with an outer membrane of plasticscoated aluminium foil was provided with the following substances in the given ratios.

| | | |
|---|---|---|
| The first compartment: | | |
| Ethylene diaminotetra acetic acid | 20 g | |
| Hydroquinone | 312 g | |
| 1-phenyl-3-pyrozolidone | 8 g | |
| Sodium sulphite | 1250 g | 1590 g |
| The second compartment: | | |
| Potassium bromide | 75 g | |
| Borax | 312 g | |
| Sodium hydroxide | 168 g | 555 g |
| Total bag contents | | 2145 g |

Evacuation and sealing of the bag was subsequently effected. Following storage of the bag with contents for about 1.5 months, the bag was opened and its contents were discharged and stirred into 19 liters of water. Dissolution of the solid material was readily and quickly performed and from the subsequent use of the developer thus produced, it resulted that the properties of the developer corresponded to the properties which were obtained with developer made on the basis of completely fresh chemicals.

Although specific embodiments have been described above, they serve only to explain and clarify the invention and not to limit it. Thus the scope of the invention is defined exclusively by the appended patent claims.

We Claim:

1. A package comprising a bag divided into at least two separate compartments holding respective measured fillings of different, mutually reactive, photographic chemicals, said bag comprising a flexible, substantially airproof outer membrane which defines an enclosed chamber, and at least one flexible partition wall that divides the chamber into said two compartments, said bag being divided into a storage portion and a neck portion, said partition wall and said compartments extending across both portions, wherein portions of the compartments residing within said bag storage portion contain almost the entire measured fillings of chemicals while the portions of the compartments residing within said bag neck portion contain only minor amounts of chemicals, wherein said neck portion is adapted to permit a single cut to form respective pouring openings from both compartments to the surroundings, and wherein said neck portion has such length that said pouring openings of the compartments may be disposed at such distance from said storage portion that said fillings of chemicals may be retained in said bag storage portion by pinching a part of said neck portion while said pouring openings are conveyed below a liquid surface to allow substantially simultaneous subsequent discharge of the fillings into the liquid, while substantially avoiding contact between the chemicals and the ambient air and without the chemicals contacting each other prior to their discharge into the liquid, the fillings of chemicals being powderous, said bag being evacuated of air and sealed to render the powderous fillings substantially immovable as long as the sealing is intact, and said Powderous fillings being arranged to make said storage portion substantially box-shared and rigid while the neck portion is flexible.

2. The package according to claim 1, wherein said outer membrane comprises a laminate composed of an airproof, heat resistant film and a fusible film.

3. The package according to claim 1, wherein said bag comprises two partition walls which divide said enclosed chamber into three separate compartments.

4. A method of packaging at least two mutually reactive photographic chemicals comprising filling of the photochemicals into respective, upwardly opening compartments formed in a bag comprising flexible, substantially airproof outer membranes that are joined by two lateral weldings and that form an upwardly open chamber, and at least one flexible partition wall that divides the chamber into the respective upwardly opening compartments, said method comprising the steps of:

filling the compartments in an essentially balanced manner and with measured amounts, and proportioning the compartments and the bag in such a manner relative to the measured amounts that, following filling, a non-filled region of the bag remains, followed by airproof closing of the bag opening at the uppermost neck portion so as to hermetically seal each of the two compartments, during filling, pinching respective ones of the lateral weldings, supporting the partition wall during filling, and, evacuating the package prior to closing to establish a subatmospheric pressure inside the bag.

5. A method according to claim 4 wherein, during filling, the package is secured to two pairs of jaws, wherein each pair of jaws pinches a respective one of the lateral weldings, and that, during filling, the partition wall is supported by supporting means which are introduced into the bag from above.

6. A method according to claim 5, wherein said partition wall is extended during filling by the supporting means maintaining it in a waved path seen in a section perpendicular to the lateral weldings, said partition wall being extended between the two pairs of jaws.

7. A method according to claim 6, wherein, following filling, the bag is vibrated so as to even out the surface of the filling material, and that the filling material is shaped to make the package substantially box-shaped following evacuation.

* * * * *

UNITED STATES PATENT AND TRADEMARK OFFICE

CERTIFICATE OF CORRECTION

PATENT NO. : 5,938,034

DATED : August 17, 1999

INVENTOR(S) : Josephsen et al.

It is certified that error appears in the above-indentified patent and that said Letters Patent is hereby corrected as shown below:

On the Title Page, Change Assignee Country of "Germany" to --Denmark--;

Column 08, line 54, "Powderous" should be --powderous--;

Column 08, line 56, "box-shared" should be --box-shaped--;

Column 01, line 23, delete "of" second occurence

Column 03, line 03, "eachother" should be --each other--;

Column 04, line 31, "sub-stantially" should be --substantially--;

Column 04, line 59, "illu-stration" should be --illustration--;

Column 05, line 08, "horisontal" should be --horizontal--;

Column 05, line 57, "eachother" should be --each other--;

Column 05, line 63, "compart-ment" should be --compartments--;

Column 07, line 54, "plasticcoated" should be --plastics coated--.

Signed and Sealed this

Twenty-sixth Day of December, 2000

*Attest:*

Q. TODD DICKINSON

*Attesting Officer*

*Director of Patents and Trademarks*